US005452064A

United States Patent [19]

Inomata

[11] Patent Number: 5,452,064

[45] Date of Patent: Sep. 19, 1995

[54] IMAGE FORMING APPARATUS HAVING A TRANSFER MEMBER ROTATABLE IN SYNCHRONISM WITH A PHOTOSENSITIVE MEMBER

[75] Inventor: Mitsugu Inomata, Kawasaki, Japan

[73] Assignee: Canon Kabushiki Kaisha, Tokyo, Japan

[21] Appl. No.: 273,159

[22] Filed: Jul. 22, 1994

Related U.S. Application Data

[63] Continuation of Ser. No. 979,271, Nov. 20, 1992, abandoned.

[30] Foreign Application Priority Data

Nov. 22, 1991 [JP] Japan ..... 3-332763

[51] Int. Cl.[6] ..... G03G 15/14; G03G 15/00

[52] U.S. Cl. ..... 355/271; 355/200; 355/326 R

[58] Field of Search ..... 355/200, 210, 211, 271, 355/326 R, 327; 118/645

[56] References Cited

U.S. PATENT DOCUMENTS

| | | | |
|---|---|---|---|
| 4,591,258 | 5/1986 | Nishino et al. | 355/200 |
| 4,705,386 | 11/1987 | Ogita et al. | 355/327 |
| 4,723,145 | 2/1988 | Takada et al. | 355/326 X |
| 5,070,370 | 12/1991 | Bellis | 355/271 |
| 5,103,261 | 4/1992 | Matsuo et al. | 355/210 |
| 5,111,242 | 5/1992 | Tanimoto et al. | 355/200 |
| 5,124,747 | 6/1992 | Haneda et al. | 355/200 |

FOREIGN PATENT DOCUMENTS

| | | | |
|---|---|---|---|
| 0473182 | 3/1992 | European Pat. Off. | 355/326 |
| 0072159 | 4/1983 | Japan . | |
| 0100160 | 6/1985 | Japan | 355/327 |
| 0171073 | 7/1991 | Japan | 355/326 |
| 0110869 | 4/1992 | Japan | 355/326 |
| 0181952 | 6/1992 | Japan | 355/271 |

*Primary Examiner*—William J. Royer

*Attorney, Agent, or Firm*—Fitzpatrick, Cella, Harper & Scinto

[57] ABSTRACT

An image forming apparatus includes a first rotatable member for bearing an image, the first rotatable member having a first driving gear; a second rotatable member rotatable in synchronism with the first rotatable member, the second rotatable member having a second driving gear; a transfer device for transferring the image from the first rotatable member onto the second transfer member; and driving source for driving the first driving gear and the second driving gear; wherein the second driving gear is driven not through the first driving gear.

25 Claims, 8 Drawing Sheets

IMAGE FORMING APPARATUS HAVING A TRANSFER MEMBER ROTATABLE IN SYNCHRONISM WITH A PHOTOSENSITIVE MEMBER

This application is a continuation of application Ser. No. 07/979,271, filed Nov. 20, 1992, now abandoned.

FIELD OF THE INVENTION AND RELATED ART

The present invention relates to an image forming apparatus such as a copying machine or printer, more particularly to an image forming apparatus comprising a transfer rotatable member rotatable in synchronism with a photosensitive member.

Most of image forming apparatuses such as full-color copying machines, comprises a photosensitive member and a transfer drum, in which a superposing image transfer system is used to transfer sequentially monochromatic toner images from a photosensitive member onto a transfer material supported on a transfer drum. According to this system, the toners are properly mixed, so that a high quality image can be provided.

Referring to FIG. 9, this system will be described. A transfer material P carried on a transfer drum 6 at a predetermined place thereon is fed to a transfer position where the photosensitive drum 1 and the transfer drum 6 are faced to each other, in timed relation to accomplish this, the transfer drum 6 and the photosensitive drum 1 are rotated in synchronism with each other. Therefore, a drum gear 100 and a transfer drum gear 101 at the respective longitudinal ends of the photosensitive drum 1 and the transfer drum 6, are in meshing engagement with each other, so that the transfer drum is rotated by way of the photosensitive drum 1. In this case, the drum gear 100 is rotated through an idler gear 102 from a driving source 18 provided in a main assembly 17 of the apparatus.

However, in such a system, two gears, i.e., an idler gear 102 at the driving source 18 side and a transfer drum gear 101 for the transfer drum 6, are engaged with the drum gear 100 for the photosensitive drum 2 which is required to rotate with high accuracy. Therefore, the rotational speed of the photosensitive drum 1 becomes uneven because it is significantly influenced by a pitch unevenness between tooth of the gear (the transfer drum gear has a large pitch circle, and therefore, the pitch thereof is not very accurate). If this occurs, the image quality is deteriorated.

On the other hand, for the purpose of easy maintenance of the apparatus, a monochromatic image forming apparatus of a process cartridge has been put into practice in which a photosensitive member, a charger, a developing device and the like are assembled into a unit which is detachably mountable to a main assembly of the image forming apparatus.

When the easy maintenance concept is incorporated in an apparatus having a transfer drum as in a full-color machine, the operativity in the mounting and dismounting is not good because the gear of the photosensitive drum has to be engaged with both the transfer drum gear and the driving source side gear.

SUMMARY OF THE INVENTION

Accordingly, it is a principal object of the present invention to provide an image forming apparatus capable of providing images with correct color registration.

It is another object of the present invention to provide an image forming apparatus wherein a transfer drum is rotated not through a driving gear for the photosensitive drum.

It is a further object of the present invention to provide an image forming apparatus in which a cartridge operativity is good.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
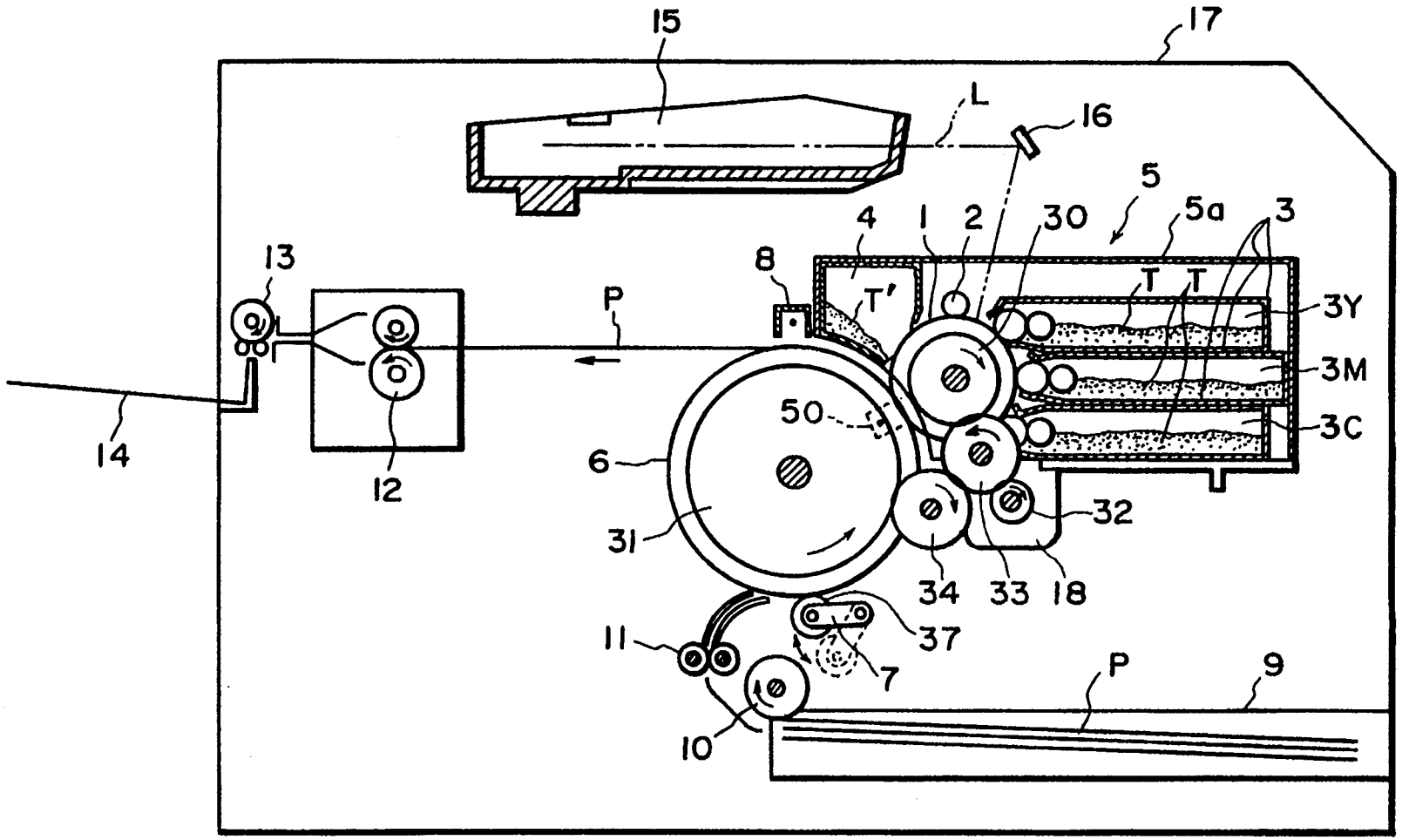
FIG. 1 is a side sectional view of an image forming apparatus according to a first embodiment of the present invention.

Referring to FIG. 1, the description will be made as to a first embodiment.

FIG. 1 shows a laser beam printer (LBP) capable of forming full-color images using yellow, magenta and cyan toner particles. It comprises a photosensitive drum (electrophotographic photosensitive member) as an image bearing member rotated in the direction of an arrow. Around the photosensitive drum 1, there are provided process means such as a charging roller 2 (three developing devices 3, more particularly a yellow developing device 3Y containing yellow toner, a magenta developing device 3M containing magenta toner and a cyan developing device 3C containing cyan toner) and cleaning device 4. The process means including the photosensitive drum 1 are integrally assembled in a cartridge frame 5*a*. The process cartridge 5 is detachably mountable to a main assembly 17 of the apparatus. The process cartridge structure is effective to easy maintenance, because exchange of the entire process cartridge 5 not changing respective parts, is enough when the toner T in the developing devices 3 is used up, or when the cleaning device 4 becomes full of toner T'.

A cylindrical transfer drum 6 is disposed at a position facing to the photosensitive drum 1. The transfer drum 6 is effective to carry thereon a transfer material P electrostatically positioned at a predetermined position thereon to have the toner image transfer from the photosensitive drum 1 (first rotatable member) onto the transfer material P. The transfer drum may have a known structure as shown in U.S. Pat. No. 4,875,069, for example. The transfer drum 6 is disposed in close proximity to the photosensitive drum 1 or in peripheral surface contact with the photosensitive drum 1. The toner image is transferred from the photosensitive drum 1 onto the transfer material P by means of transfer means such as a transfer charger 50 or transfer bias voltage application means for applying a transfer bias to the outer peripheral surface of the transfer drum. Here, the recording material P is sandwiched between the photosensitive drum 1 and the transfer drum 6. Adjacent a position to which the recording material is supplied, there is provided an attraction roller 37 for electrostatically attracting the transfer material P onto the outer peripheral surface of the transfer drum. A separation charger 8 is disposed at a proper position to separate the electrostatically attracted transfer material P from the transfer drum 6.

On the supply side of the transfer drum 6, there are disposed a sheet feeding cassette 9, sheet feeding rollers 10, registration rollers 11. In the sheet discharge side, there are a fixing device 12, discharging rollers 13 and sheet discharging tray 14. Above the process cartridge 5, there are a laser scanner 15 comprising a semiconductor laser and polygonal mirror to emit image light L bearing image information in a predetermined color onto a photosensitive drum 1, and folding mirror 16 for projecting the image light L from the laser scanner 15 onto the photosensitive drum 1.

The image forming process will be described. The photosensitive drum 1 is uniformly charged by a charging roller 2 and is exposed to image light L of yellow image information for example by way of the laser scanner 15 or the like. By this, an electrostatic latent image of the yellow image information is formed on the photosensitive drum 1. The electrostatic latent image is carried to the yellow developing device 3Y with the rotation of the photosensitive drum 1. The yellow developing device 3Y supplies yellow toner T to the photosensitive drum to develop the latent image into a toner image. The toner image is transferred onto a transfer material P carried on the transfer drum 6 rotating in timed relation with the toner image.

After the residual toner T′ is removed by a cleaning device 4 after being subjected to the image transfer operation, the photosensitive drum 1 is again uniformly charged by the charging roller 2. The photosensitive drum 1 is then exposed to another image light L representative of magenta image information by way of the laser scanner 15 or the like, so that another electrostatic latent image is formed. The electrostatic latent image is developed by the magenta developing device 3M which supplies the magenta toner T. By this, a toner image is produced and is transferred superposedly onto the same transfer material P already having the yellow toner image. Through the similar processes, a cyan toner image is superposedly transferred onto the transfer material P. Thus, a full-color image is formed by superposing different color images onto the same recording material. As described, when the plural toner images formed by respective rotations of the photosensitive drum (first rotatable member) are sequentially transferred onto the same recording material, the image formation start positions (exposure start positions) are always the same in the rotational direction of the first rotatable member.

On the other hand, a transfer material P is fed out one-by-one by the feeding roller 10 from a sheet feeding cassette 9. Thereafter, it is fed to the registration rollers 11, and it is supplied onto the outer peripheral surface of the transfer drum 6 in timed relation by the registration rollers 11. In this case, the transfer material P is positioned and retained by being attracted onto the outer peripheral surface of the transfer drum 6 by the attraction roller 37, which is mounted on arm 7. The transfer material P is fed to a transfer position where the photosensitive drum 1 and the transfer drum 6 are opposed to each other, with the rotation of the transfer drum 6. Then, the toner images of yellow, magenta and cyan toners T, are sequentially transferred.

The transfer material P having received the transferred image is separated electrically from the transfer drum 6 by a separation charger 8, and is fed to the fixing device 12, which fuses the toner images and fixes them as a full-color image. Then, the transfer material is discharged by discharging rollers 13 and is accommodated on a discharge tray 14.

In order to feed the transfer material P it is retained on the outer peripheral surface of the transfer drum 6 in timed relation with a toner image formed on the photosensitive drum 1, the transfer drum 6 is rotated in synchronism with the photosensitive drum 1. In order to accomplish this, it would be possible that a drum gear (first driving gear) (first driving force receiving portion) 30 and a transfer drum gear (second driving gear, second driving force receiving portion) 31 of the photosensitive drum 1 and the transfer drum 6, respectively, at the same longitudinal ends, are directly meshed, by which the driving source 18 rotates the, drum gear 30, and the drum gear 30 in turn rotates the transfer drum gear 31. As described in conjunction with the related art, if this is done, the drum gear 30 is meshed with two gears (transfer drum gear and the driving side gear), with the result of being influenced by uneven gear pitches of the transfer gear and the driving side gear, and therefore, the image quality deterioration or the like.

Accordingly, in the present invention, the driving force path from one driving source 18 in the main assembly 17 of the apparatus, is branched into two paths, and the photosensitive drum 1 and the transfer drum 6 are rotated through different driving force paths. Thus, the second driving gear is driven not through the first gear. Even if the photosensitive drum 1 and the transfer drum 6 are rotated through different paths, the transfer drum 6 is rotated in synchronism with the photosensitive drum 1 since a common driving source 18 is used. Separate driving sources may be used for the drum gear 30 and for the transfer gear, respectively, but a common driving source is preferable since the synchronization is easy.

First and second idler gears 33 and 34 (driving force transmitting means) are at the main assembly 17 side, the first idler gear 33 is meshed with a driving gear 32 fixed on a driving shaft of the driving source 18, and the first idler gear 33 is meshed with the drum gear 30. Thus, the photosensitive drum 1 is rotated through one of the driving paths from the driving source 18. In addition, the second idler gear 34 is meshed with the first idler gear 33, and the second idler gear 34 is meshed with the transfer gear 31, so that the transfer drum 6 is rotated through another driving path from the driving source 18.

The drum gear 30 of the photosensitive drum 1 is meshed only with the first idler gear 33, and therefore, even if there are pitch unevenness or the like between drum gear 36 and the idler gear 33, the influence thereof to the evenness of the rotational speed of the photosensitive drum 1 is less than one half as compared with the case in which also the transfer drum gear 31 is engaged. Thus, the influence of the pitch unevenness on the image is reduced. The transfer gear 31 has a large diameter with a large number of teeth, and the manufacturing accuracy (pitch accuracy of the tooth) is not very high, generally. In this embodiment, the drum gear 30 is not required to be in meshing engagement with such a transfer gear 31. This is also effective to suppress the non-uniformity of the photosensitive drum 1 speed.

In addition, the transfer gear 31 is driven not through the drum gear 30, and therefore, even if a thick transfer material P is used, the clearance between the transfer drum 6 and the photosensitive drum 1 can be easily accomplished by slightly rotating away from the photosensitive drum about the second idler gear 34 with the transfer gear 31 in meshing engagement with the second idler gear 34. If the transfer gear 31 and the drum gear 30 are meshed, such adjustment would result in improper meshing engagement between the transfer gear 31 and the drum gear 30, so that the improper image would be produced.

When the process cartridge 5 is mounted or dismounted in a direction perpendicular to the direction of the generating line of the transfer drum 6, it will suffice if the drum gear 30 is brought into or out of engagement with the first idler gear 33. Therefore, as compared with the case in which it is brought into or out of meshing engagement with two gears, the mounting and dismounting operations of the process cartridge 5 are easier. Thus, the positioning accuracy of the process cartridge 5 is improved, that is, the drum gear 30 and the first idler gear 33 can be correctly meshed. This permits rotation of the photosensitive drum 1 at the correct rotational speed, and therefore, improper image production can be prevented. Here, the gears are used to transmit the driving force, but a belt or belts in place thereof is usable. What is mounted or dismounted relative to the main assembly 17 of the apparatus may be only the photosensitive drum. In the case of cartridge type, the cartridge may comprise the photosensitive member and at least one of the charger, developing devices and the cleaner.

Figure 2:
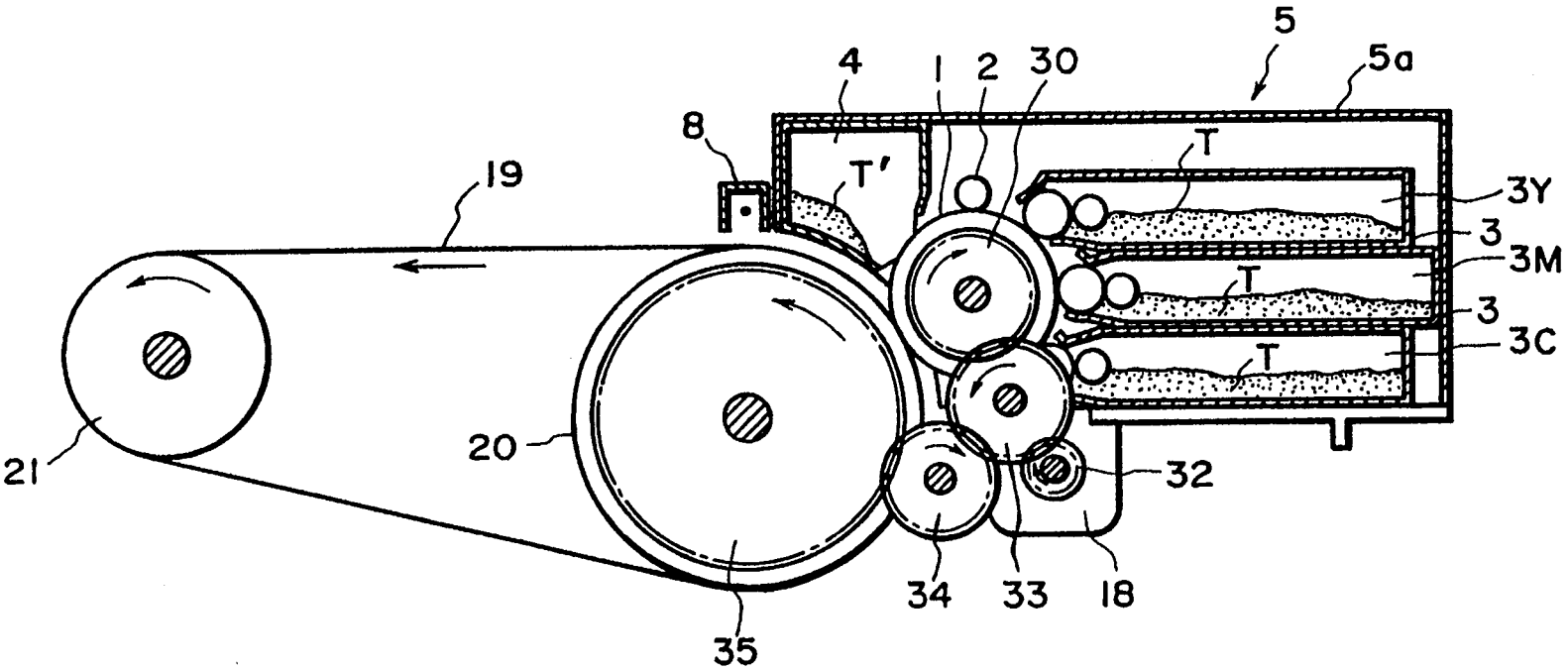
FIG. 2 is a side sectional view of a major part of an image forming apparatus according to a second embodiment of the present invention.

Referring to FIG. 2, the description will be made as to a second embodiment. The same reference numerals as in the first embodiment are assigned to the elements having the corresponding functions, and the detailed description thereof are omitted for simplicity.

In this embodiment, three color toner images formed on the photosensitive drum 1 with yellow, magenta and cyan toners T, is once transferred superposedly onto a known intermediate transfer member (second rotatable member) 19. Then, the superposed toner images are transferred at once onto the transfer material P to produce a full-color image. FIG. 2 shows the structures around the intermediate transfer member 19 of the image forming apparatus of this embodiment. The other structures are the same as in the image forming apparatus of the first embodiment, and therefore, are omitted in the Figure.

The intermediate transfer member 19 is in the form of an endless belt (sheet) rotatable around a drum 20 and a follower roller 21 adjacent the photosensitive drum 1. At the position of contact between the intermediate transfer member 19 and the photosensitive drum 1, the yellow, magenta and cyan toner images are transferred superposedly from the transfer drum 1. The drum 20 is in the form of a cylindrical drum to rotate the intermediate transfer member 19 while positioning it correctly. The toner image is transferred from the photosensitive drum 1 onto the intermediate transfer member 19 by an unshown transfer charger disposed in the drum 20 or by a transfer bias voltage applied to the outer peripheral surface thereof.

The electrostatic latent images corresponding to the yellow, magenta and cyan image information, formed on the photosensitive drum 1 through the laser scanner 15 or the like as in FIG. 1 embodiment, are visualized as toner images by yellow, magenta and cyan developing devices 3Y, 3M and 3C, respectively. The visualized images are superposedly transferred onto the intermediate transfer member 19 rotationally moved between the transfer drum 20 and the follower roller 21. The transfer material P in the cassette 9 is fed out one-by-one to a predetermined position (unshown transfer position) of the intermediate transfer member 19 by the feeding roller 10 and registration rollers 11 in timed relation with the toner image. The toner images on the intermediate transfer member 19 are transferred at once onto the transfer material P. The transfer material P now having the three toner images, is fed to the image fixing device 12, by which the toner images are fused and mixed and fixed on the transfer material P as a full-color image. Thereafter, the transfer material P is discharged onto a sheet discharge tray 14 by discharging rollers 13.

In the image forming apparatus using the intermediate transfer member 19, it is required that the intermediate transfer member 19 is moved to the photosensitive drum 1 with timed relation, and therefore, the drum 20 is required to be rotated in synchronism with the photosensitive drum 1. Therefore, in this embodiment, the main assembly 17 of the apparatus is provided with first and second idler gears 33 and 34, and similarly to the first embodiment, the drum gear 30 of the process cartridge 5 is rotated by way of the first idler gear 33 by the driving gear 32 of the driving source 18. The first idler gear 33 is meshed with the second idler gear 34, and the transfer gear 35 mounted to an end of the drum 20 is rotated by way of the second idler gear 34. In this manner, the photosensitive drum 1 and the drum 20 are rotated through separate driving paths.

Therefore, also in this embodiment, the drum gear 30 of the photosensitive drum 1 is meshed with only the first idler gear 33, so that the unevenness of the rotational speed of the photosensitive drum 1 is suppressed. Thus, similarly to the first embodiment, the uneven pitch of the image can be avoided. When the process cartridge 5 constituted by the photosensitive drum 1, the charging roller 2, the developing device 3, the cleaning device 4 and the like is mounted to or dismounted from the main assembly 17, the engagement or disengagement between the drum gear 30 and the first idler gear 33 is sufficient. Therefore, the mounting and dismounting operation of the process cartridge 5 is made easier, and in addition, the positional accuracy of the process cartridge 5 is improved. This is also effective to prevent the low quality image formation.

Referring to FIGS. 3, 4, 5 and 6, the description will be made as to a third embodiment. In this embodiment, the same reference numerals as in the first embodiment have been assigned to the elements having the corresponding functions, and the detailed explanation thereof is omitted for simplicity.

In this embodiment similarly to the first embodiment, the photosensitive drum 1 and the transfer drum 6 are driven through separate driving paths from a common driving source 18. In this embodiment, the relative positional relationships, in the longitudinal and circumferential directions, between the photosensitive drum 1 and the transfer drum 6, can be determined with high accuracy by simple means, thus avoiding the improper image formation and making easier the mounting and dismounting operation of the process cartridge 5. The fundamental structure and the operations of the image forming apparatus is the same as in the first embodiment, the detailed description thereof is omitted for simplicity. The following description is directed mainly to the driving mechanism for the photosensitive drum 1 and for the transfer drum 6.

Between the drum gear 30 of the photosensitive drum 1 and the driving gear 32 of the driving source 18, the drum gear (driving force transmitting means) 30 and a small gear 36*a* are meshed with each other, and the driving gear 32 and a large gear 36*b* are meshed with each other. The small gear 36*a* and the large gear 36*b* constitute a coaxial idler gear 36 having a stepped portion. Another idler gear 37 is meshed between the large gear 36*b* of the idler gear 36 and the transfer gear 31. Thus, the photosensitive drum 1 is rotated through the driving force path including the driving source 18, the driving gear 32, the large gear 32*b* of the stepped idler gear 36, the small gear 36*a* of the stepped idler gear 36 and the drum gear 30, whereas the transfer drum 6 is rotated through a driving path including the driving source 18, the driving gear 32, the large gear 36*b* of the stepped idler gear 36, the idler gear 37 and the transfer gear 31. In this manner, the photosensitive drum 1 and the transfer drum 6 are rotationally driven through the separate driving paths from the common driving source 18. Therefore, the same advantageous effects as in the first embodiment are provided in this embodiment.

In this embodiment, the drum gear 30 and the transfer gear 31 are thrust gears which produce axial force upon rotation. Examples of the thrust gear include a helical gear or the like in which the teeth are not parallel to the rotational axis but are twisted. This is effective to apply the thrust force (axial force) to the photosensitive drum 1 and the transfer drum 6 in the direction of the generating lines of these elements during image forming operation, by which the photosensitive drum 1 and the transfer drum 6 are correctly positioned in the axial direction. In this embodiment, all the gears are thrust gears for the convenience of the meshing engagements between gears.

When the thrust gear is rotated, the force is produced in the direction perpendicular to the tooth face. Therefore, if a gear A having a tooth face inclined downwardly toward the right, is rotated in the clockwise direction, the thrust force F1 is directed downwardly. The direction of the thrust force F1 is determined by the rotational direction of the thrust gear and the direction of the tooth face. Since the rotational directions of the photosensitive drum 1 and the transfer drum 6 are opposite from each other, the photosensitive drum 1 and the transfer drum 6 receive the thrust forces F2 and F3 during their rotations, if the inclining directions of the drum gear 30 and the transfer gear 31 are made opposite, as shown in FIG. 5.

Figure 5:
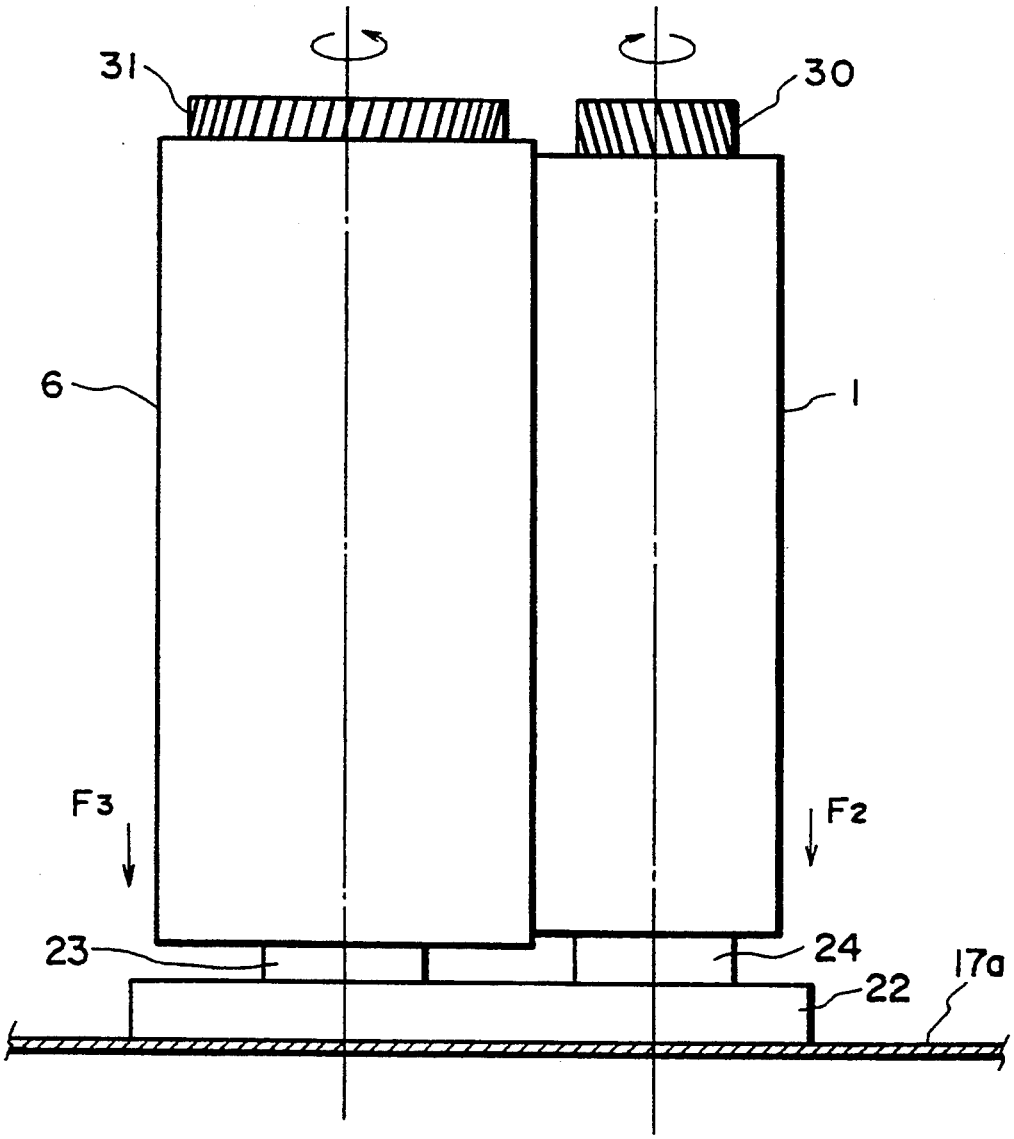
FIG. 5 is a sectional view taken along a line X—X of FIG. 3 when a direction of a thrust force applied to the photosensitive drum and the transfer drum is changed.

As shown in FIG. 5, on the other hand, a side wall of the main assembly 17*a* of the apparatus is provided with a positioning member 22, and the positioning member 22, for example, is provided with a bearing 23 for the transfer drum 6, so that the transfer drum 6 is pressed to the positioning member 22 (arrow in the Figure), by which the transfer drum 6 is correctly positioned to the positioning member 22 in the axial direction through the bearing 23. By pressing the photosensitive drum 1 to the positioning member 22 (arrow in the Figure) through the bearing 24 of the photosensitive drum 1 on the cartridge frame 5*a*, the photosensitive drum 1 is correctly positioned to the positioning member 22 in its longitudinal or axial direction. Accordingly, if the photosensitive drum 1 and the transfer drum 6 are pressed to the positioning member 22 side in the axial direction, the relative positional relationship in the axial direction is determined between the photosensitive drum 1 and the transfer drum 6.

Figure 3:
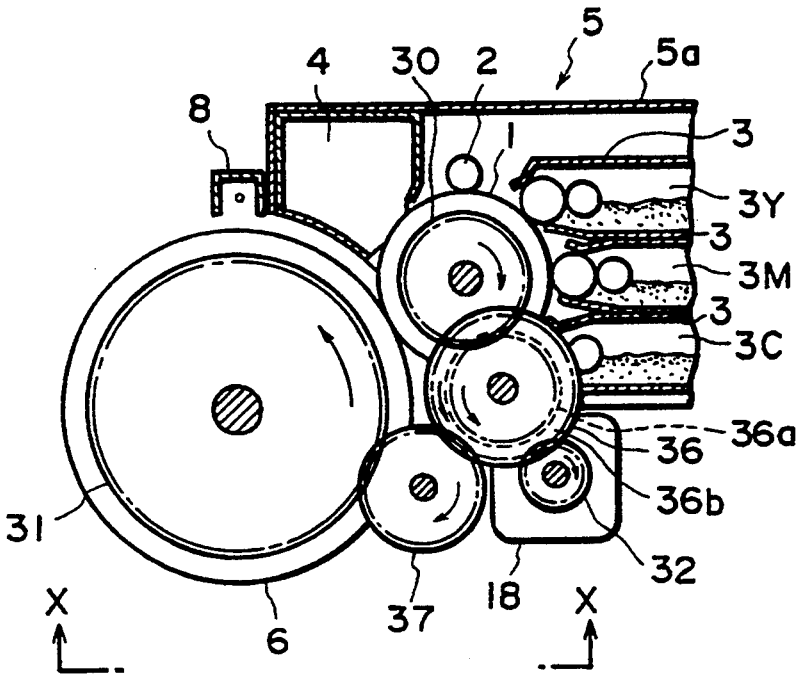
FIG. 3 illustrates a driving system for the photosensitive drum and the transfer drum in an image forming apparatus according to a third embodiment of the present invention.
Figure 4:
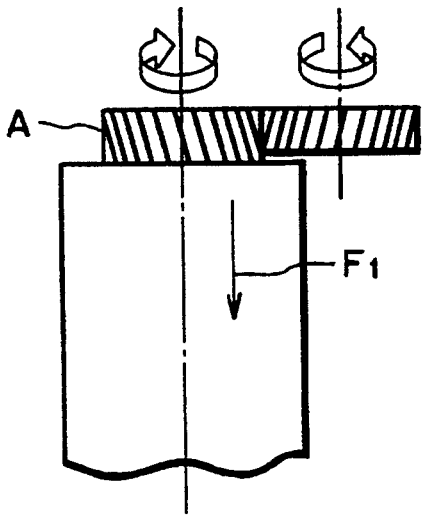
FIG. 4 illustrates operation of a thrust gear.

By the clockwise rotation of the driving gear 32 of the driving source 18 in FIG. 3, the drum gear 30 is rotated in the clockwise direction through the stepped idler gear 36, and the transfer gear 6 is rotated in the counterclockwise direction through the stepped idler gear 36 and the idler gear 37. In this manner, the photosensitive drum 1 is rotated in the clockwise direction, and the thrust force resulting from the drum gear 30 in the form of a thrust gear correctly positions in the axial direction the photosensitive drum 1 to the positioning member 22 through the bearing 24. Similarly, the transfer drum 6 is rotated in the counterclockwise direction, and the thrust force resulting from the transfer gear 31 in the form of a thrust gear correctly position it in the axial direction to the positioning member 2 through the bearing 23. Accordingly, during the image forming operation, the relative positional relation in the axial direction between the photosensitive drum 1 and the transfer drum 6 is maintained constant. Even if the toner images of various colors are transferred from the photosensitive drum 1 onto the transfer material P correctly positioned on the transfer drum 6, the toner images are not out of registration in the axial direction of the transfer drum 6.

As described in the foregoing, by the simple structure of employing thrust gear structures in the drum gear 30 and the transfer gear 31, the relative positional relationship can be determined with high accuracy in the axial direction between the photosensitive drum 1 and the transfer drum 6. In the multi-color image formation or the like, the improper image formation can be effectively prevented. This eliminates the necessity for pressing the photosensitive drum 1 and the transfer drum 6 to the positioning member 22 with a specific pressing mechanism, the cost and size of the apparatus can be reduced, and in addition, the mounting and dismounting of the process cartridge 5 relative to the main assembly 17 is made easier.

Figure 6:
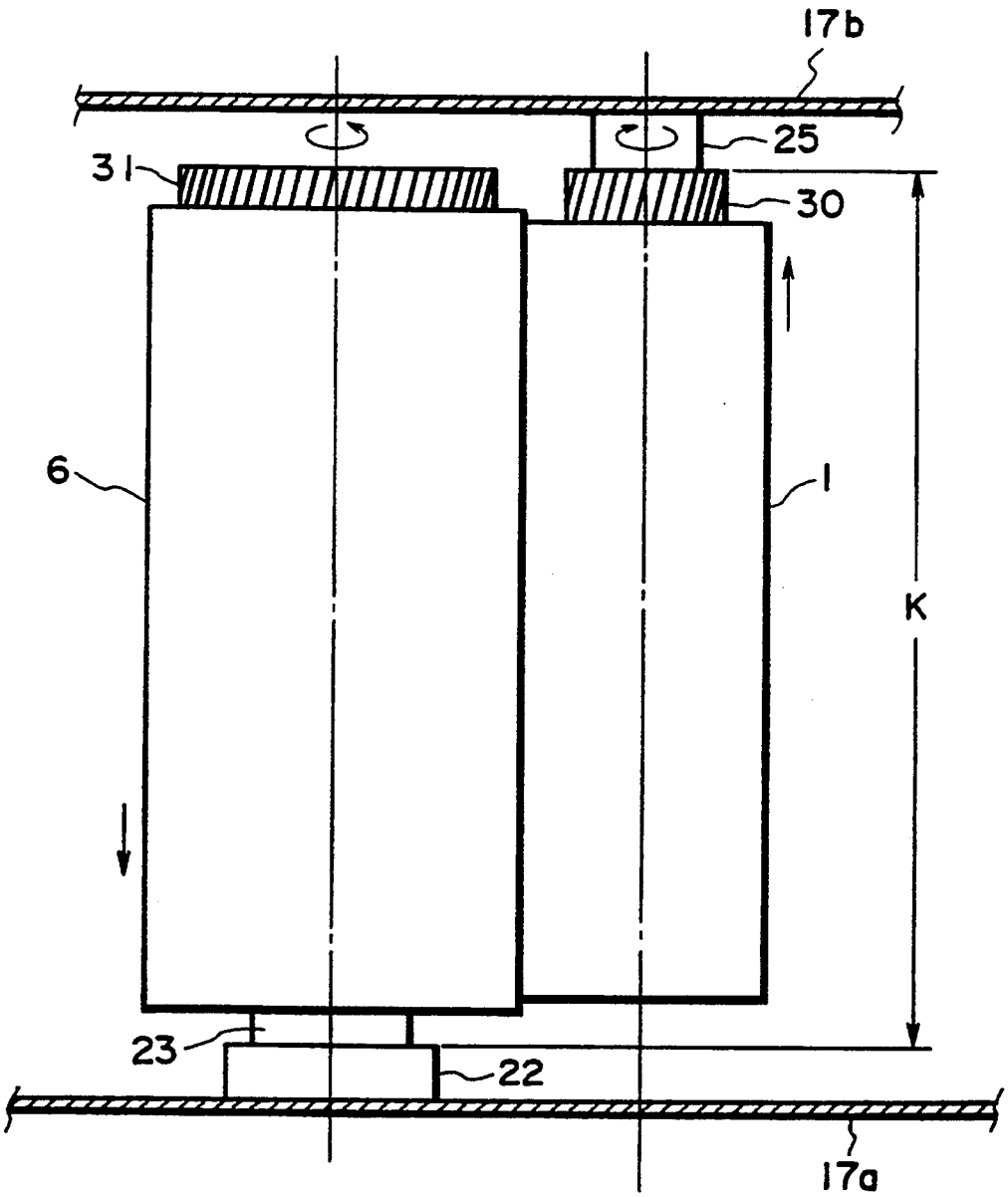
FIG. 6 is a view of a transfer gear and a drum gear according to a third embodiment of the present invention.

As shown in FIG. 6, it is a possible alternative that the teeth of the drum gear 30 are directed in the same direction as the transfer gear 31 to press the photosensitive drum 1 to a positioning member 25 mounted on the opposite side wall of the main assembly 17*b* through the drum gear 30, if a distance K between the two positioning members 23 and 25 is constant, since then the relative positional relationship between the photosensitive drum 1 and the transfer drum 6 can be maintained constant. The same advantageous effects can be provided. It is preferable that the two positioning members are the same from the standpoint of the positioning accuracy.

In this embodiment, all of ratios between the numbers of teeth of the gears in the two branched driving force paths to the photosensitive drum 1 and to the transfer drum 6 from the common driving source 18, namely, the driving force path constituted for the photosensitive drum 1 by the large gear 36*b* of the stepped idler gear, the small gear 36*a* thereof and the drum gear 30, and the driving force path for the transfer drum 6 constituted by the large gear 36*b* of the stepped idler gear 36, the idler gear 37 and the transfer gear 31. In other words, the adjacent gears between the driving source to the first driving gear for each of the drums, have the same numbers of the teeth, or such numbers of teeth that a larger number is the smaller number multiplied by an integer. By doing so, the photosensitive drum 1 and the transfer drum 6 are not deviated in the circumferential direction in each rotation. For example, the number of teeth of the large gear 36*b* of the stepped idler gear 36 is 100; the number of the teeth of the small gear 36*a* is 50; the numbers of the idler gears 37 and the drum gear 30 are 50; and that of the transfer gear 31 is 200.

Since the numbers of the teeth in the branched driving paths to the photosensitive drum 1 and the transfer drum 6 are the same or are such that the larger one is the smaller one multiplied by an integer, and since the numbers of the teeth of the drum gear 30 and the small gear 36*a* of the stepped idler gear 36 are the same, the same teeth are always engaged between the gears 30 and 36*a*. Between the transfer gear 31 and the idler gear 37, the teeth number ratio is 4:1, and therefore, the same teeth are engaged always between the transfer gear 31 and the idler gear 37 under the condition that one rotation of the transfer gear 31 corresponds to the four rotations of the idler gear 37. Thus, the same advantage is provided also between the idler gear 37 and the large gear 36*b* of the stepped idler gear 36.

Therefore, even if existence of the uneven pitch of the teeth of the gears result in unevenness in image, the same unevenness results in the first and second rotations of the photosensitive drum 1. In addition, the transfer drum 6 is rotated in the same speed unevenness in the first and second rotations. Therefore, when the images are superposed, there occurs no positional misregistration in the circumferential direction of the transfer drum 6 between a first toner image and a subsequent toner images. Therefore, the color misregistration can be avoided. In the foregoing, the adjacent gears mean the gear which are in meshing engagement with each other, and do not include the coaxial large and small gears. In the latter case, it is not necessary that one is the other multiplied by the integer.

The use of the thrust gear in this embodiment, the integer ratio relation between the numbers of the teeth of the adjacent gears, can be applied to the first and second embodiment.

Figure 7:
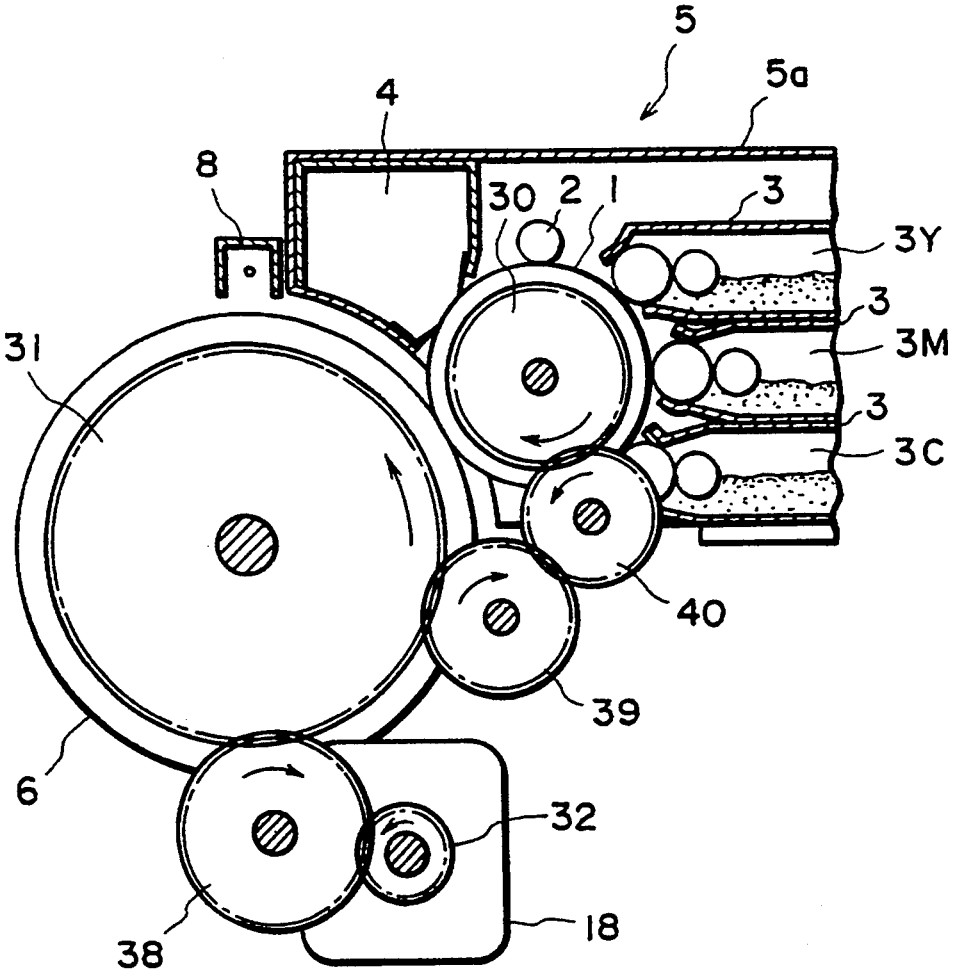
FIG. 7 illustrates a driving system for the photosensitive drum and the transfer drum of an image forming apparatus according to a fourth embodiment of the present invention.

Referring to FIG. 7, a fourth embodiment of the present invention will be described. In the description of this embodiment, the same reference numerals as in the first embodiment are assigned to the elements having the corresponding functions, and the detailed description thereof is omitted for simplicity.

In this embodiment, too, the photosensitive drum 1 and the transfer drum 6 are driven by the driving force from a common driving source 18. Predetermined gears are in the form of thrust gears, and the ratio of the numbers of the teeth of the gears, is an integer value. The fundamental structure and the operation of the image forming apparatus are the same as in the first embodiment. Therefore, the description thereof is omitted, and the description will be concentrated on the driving mechanism for the photosensitive drum 1 and the transfer drum 6.

The transfer drum gear 31 of the transfer drum 6 is rotationally driven by a driving gear 32 of the driving source 18.through a third idler gear 38 which is in meshing engagement with the driving gear 32. The drum gear 30 of the photosensitive drum 1 is rotationally driven by way of a fourth idler gear 39 meshed with the transfer gear 31 and a fifth idler gear 40 meshed with the fourth idler gear 39. Therefore, the transfer drum 6 is rotated through a driving force path including the driving source 18, the driving gear 32, the third idler gear 38 and the transfer gear 31. The photosensitive drum 1 is driven through a driving path extended from the transfer drum 6 driving force path, including the transfer gear 31, the fourth and fifth idler gears 39 and 40 and the drum gear 30. Here, two (even number) idler gears (fourth and fifth) 39 and 40 are provided between the transfer gear 31 and the drum gear 30, in order to rotate the photosensitive drum 1 and the transfer drum 6 in the opposite directions. All the gears except for the drum gear 30 disposed in the process cartridge 5, are disposed in the main assembly 17.

In this embodiment, the ratio of the numbers of the teeth of the drum gear 30, the fourth and fifth idler gears 39 and 40 and the transfer gear 31 are integers. Therefore, the transfer gear 31 and the fourth idler gear 39, the fourth idler gear 39 and the fifth idler gear 40, and the fifth idler gear 40 and the drum gear 30, are engaged with the respective same tooth for each rotation. Therefore, even if there is pitch unevenness between the tooth, the unevenness of the resulting image for each rotation of the photosensitive drum 1 becomes the same, thus improving the image quality. In addition, the speed unevenness for each rotation of the transfer drum 6 is the same. Therefore, there occurs no color misregistration or the like when different color toner images are overlaid.

Thus, when the photosensitive drum 1 and the transfer drum 6 are rotationally driven through the same driving paths through intermediate gears (fourth and fifth idler gears 39 and 40), the image quality can be improved by the simple structure, that is, the integer relation in the ratio of the teeth numbers in the drum gear 30, the transfer gear 31 and the intermediate gears 39 and 40.

In this embodiment, the drum gear 30, the transfer gear 31 are in the form of thrust gears, and in addition, the fifth idler gear 40 and the third and fourth idler gears 38 and 39 meshed with them, are in the form of thrust gears. The thrust gears may be helical gears which produce thrust force in the axial direction. Because of the meshing engagement between gears, the driving gear 32 is in the form of a thrust gear. Therefore, if a positioning member 22 or the like is disposed in the main assembly 17 to permit pressure positioning in the axial direction for the photosensitive drum 1 and the transfer drum 6, the rotation of the thrust gear is effective to press in the axial direction the photosensitive drum 1 and the transfer drum 6 to correctly determine the relative positional relationship, so that improper image formation can be avoided.

In the case where the photosensitive drum 1 and the transfer drum 6 are rotationally driven through the same driving path, the simple structure of using the thrust gears is effective to maintain the constant positional relationship between the photosensitive drum 1 and the transfer drum 6, by which the improper image formation can be avoided. In this embodiment, upon mounting and dismounting of the process cartridge 5 relative to the main assembly 17, it will be sufficient if the drum gear 30 and the fifth idler gear 40 are engaged with each other or disengaged from each other, so that the mounting and dismounting of the process cartridge 5 is made easier. In addition, the positioning of the process cartridge 5 in the main assembly 17 is also made easier. In other words, the drum gear 30 and the fifth idler gear 40 are correctly meshed, so that the improper image formation can be avoided from this, too.

In this embodiment, intermediate gears (the fourth and fifth idler gears 39 and 40) are used between the drum gear 30 and the transfer gear 31. However, only from the standpoint of using the thrust gears, the thrust drum gear 30 and the thrust transfer drum gear 31 may be directly meshed, with the same advantageous effects provided.

The same structures with same advantageous effects can be accomplished if in the image forming apparatus using an intermediate transfer member 19 as in the second embodiment, the photosensitive drum 1 and the transfer drum 20 are rotationally rotated through the same driving path through an intermediate gear or gears.

Figure 8:
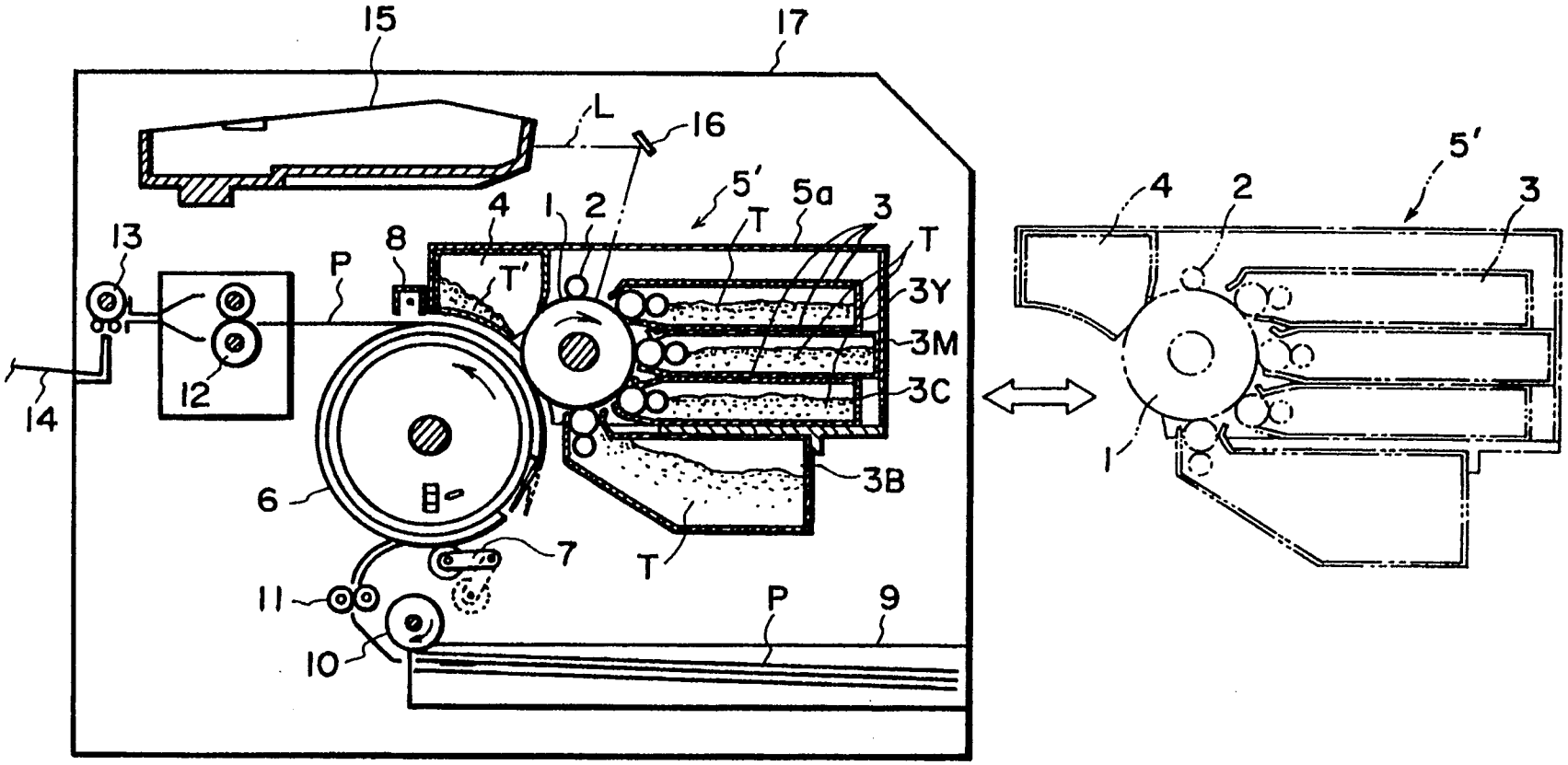
FIG. 8 is a side sectional view of an image forming apparatus according to a further embodiment of the present invention.
Figure 9:
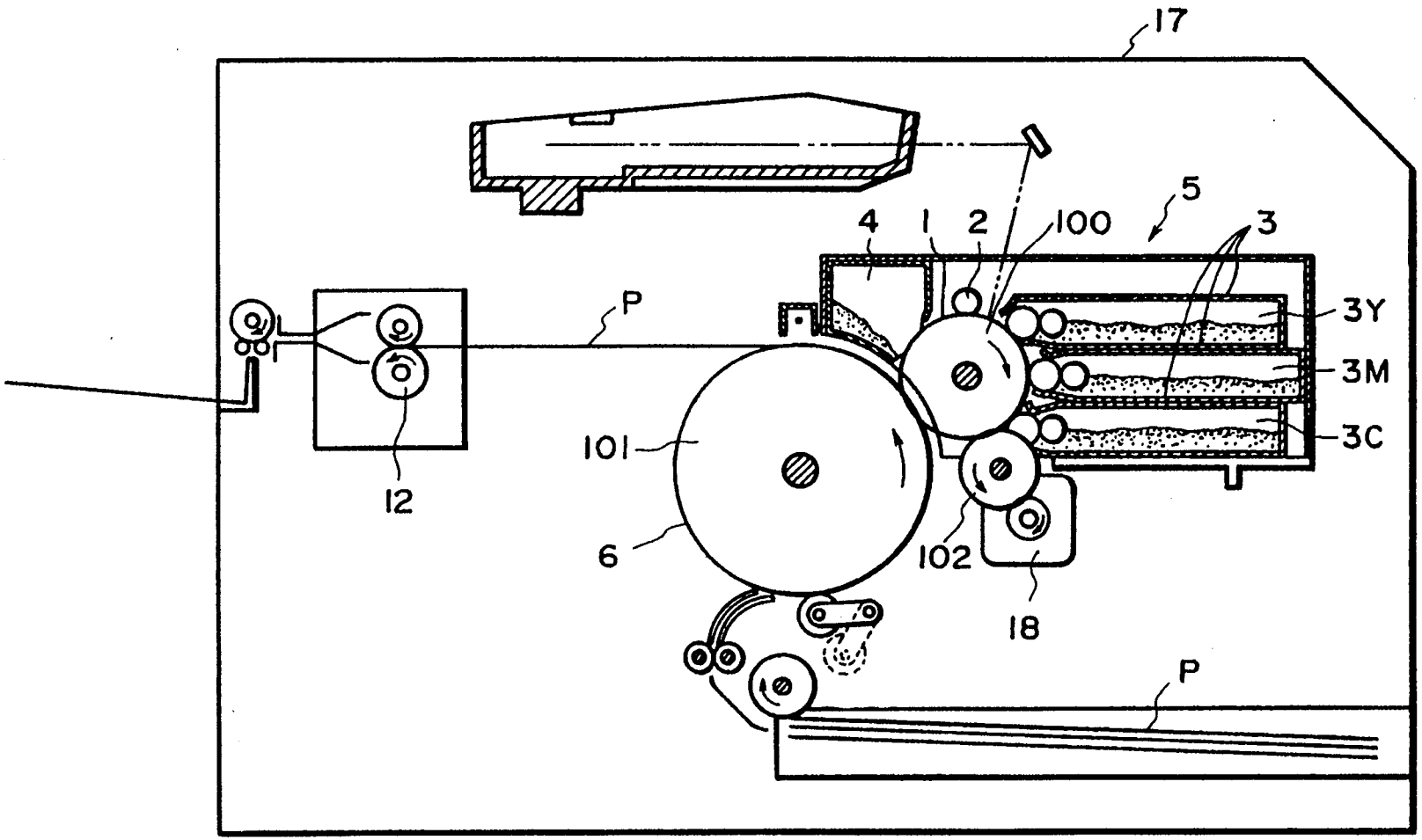
FIG.9 PRIOR ART
FIG. 9 illustrates prior art apparatus.

In the first–fourth embodiments, the image forming apparatus has been such that full-color images are formed using yellow,magenta and cyan toners. It is possible that a black developing device 3B containing black toner particles are used in addition to the yellow, magenta and cyan developing devices 3Y, 3M and 3C, as shown in FIG. 8, so as to permit full-color image formation. In this case, the black developing device 3B, as shown in FIG. 8, may be or may not be built in the process cartridge 5. In addition, the present invention is applicable to an image forming apparatus capable of forming multi-color images in red, blue and black, for example.

In the first–fourth embodiments, the description has been made with respect to an image forming apparatus usable with a process cartridge 5. However, the present invention is applicable to an image forming apparatus not usable with a process cartridge 5.

As will be understood from the foregoing description, the present invention provides the following advantageous effects.

(1) Since the image bearing member and a rotational transfer means are rotationally driven through separate driving paths from a common driving source, the image bearing member is rotated without being influenced by the rotation of the transfer means. Therefore, the pitch unevenness is suppressed in the resultant image. In addition, since the image bearing member can be driven by one driving path, the mounting and dismounting operation of the process cartridge is made easier.

(2) Since the driving gears of the image bearing member and the transfer means and the gears engageable with the driving gears are in the form of thrust gears, the relative positional relation can be maintained constant in the axial direction between the image bearing member and the rotary transfer means. When the images are overlaid, no misregistration occurs. Particularly, the axial direction positioning of the image bearing member or the like is accomplished by simple means, thrust gears or the like, the size and cost of the apparatus can be reduced, and the mounting and dismounting operation of the process cartridge are made easier.

(3) The ratio of the numbers of the teeth of adjacent gears is made an integer value, the image bearing member and the transfer means are rotated with the same pitch unevenness for each rotation even if there is pitch unevenness between the gears. When the images are overlaid, no color misregistration occurs, so that the quality of the image can be maintained.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a first rotatable member for bearing an image, said first rotatable member having a first helical gear;

a second rotatable member, rotatable in synchronism with said first rotatable member, said second rotatable member having a second helical gear;

transfer means for transferring the image from said first rotatable member onto said second rotatable member; and a driving source for driving each of said first helical gear and said second helical gear;

wherein said first rotatable member and said second rotatable member are urged in the same direction along thrust force generating lines of said first and second rotatable members by rotation of said first helical gear and said second helical gear.

2. An apparatus according to claim 1, wherein said first rotatable member includes a photosensitive member.

3. An apparatus according to claim 2, further comprising charging means for electrically charging said photosensitive member, exposure means for exposing said photosensitive member charged by said charging means, with image light, developing means for developing a latent image formed on said photosensitive member, and cleaning means for removing residual matter from said photosensitive member.

4. An apparatus according to claim 3, wherein at least one of said photosensitive member, said charging means, said developing means and said cleaning means, is detachably mountable to said apparatus as a unit.

5. An apparatus according to claim 1, wherein said apparatus is capable of forming different color images, and said transfer means sequentially transfers the different color images onto said second rotatable member.

6. An apparatus according to claim 5, wherein when the different images are color sequentially transferred onto said second rotatable member, a starting position of said second rotatable member for each color image formation is constant in a rotational direction of said first rotatable member.

7. An apparatus according to claim 1, wherein said second rotatable member is opposed to said first rotatable member.

8. An apparatus according to claim 7, wherein when said transfer means transfers the image from said first rotatable member onto said second rotatable member, said first rotatable member and said second rotatable member grip therebetween a recording material.

9. An apparatus according to claim 1, further comprising a positioning member for limiting movements of said first rotatable member and said second rotatable member in the direction of the thrust force generating lines.

10. An apparatus according to claim 9, wherein the positioning member is effective to limit both of said first and second rotatable members.

11. An apparatus according to claim 1, wherein axes of rotation of said first and second rotatable members are substantially parallel with each other.

12. An apparatus according to claim 1, wherein said second helical gear is not driven through said first helical gear.

13. An apparatus according to claim 1, further comprising second transfer means for transferring the image from said second rotatable member onto a recording material.

14. An image forming apparatus, comprising:

a first rotatable member for bearing an image, said first rotatable member having a first helical gear;

a second rotatable member for bearing a recording material, said second rotatable member rotatable in synchronism with said first rotatable member, and said second rotatable member having a second helical gear;

transfer means for transferring the image from said first rotatable member onto the recording material carried on said second rotatable member; and a driving source for driving each of said first helical gear and said second helical gear;

wherein said first rotatable member and said second rotatable member are urged in the same direction along thrust force generating lines of said first and second rotatable members by rotation of said first helical gear and said second helical gear.

15. An apparatus according to claim 14, wherein said first rotatable member includes a photosensitive member.

16. An apparatus according to claim 15, further comprising charging means for electrically charging said photosensitive member, exposure means for exposing said photosensitive member charged by said charging means, with image light, developing means for developing a latent image formed on said photosensitive member, and cleaning means for removing residual matter from said photosensitive member.

17. An apparatus according to claim 16, wherein at least one of said photosensitive member, said charging means, said developing means and said cleaning means, is detachably mountable to said apparatus as a unit.

18. An apparatus according to claim 14, wherein said apparatus is capable of forming different color images, and said transfer means sequentially transfers the different color images onto a same recording material.

19. An apparatus according to claim 18, wherein when the different images are color sequentially transferred onto the same recording material, a starting position of said second rotatable member for each color image formation is constant in a rotational direction of said first rotatable member.

20. An apparatus according to claim 14, wherein said second rotatable member is opposed to said first rotatable member.

21. An apparatus according to claim 20, wherein when said transfer means transfers the image from said first rotatable member onto the recording material, said first rotatable member and said second rotatable member grip therebetween the recording material.

22. An apparatus according to claim 14, further comprising a positioning member for limiting movements of said first rotatable member and said second rotatable member in the direction of the thrust force generating lines.

23. An apparatus according to claim 22, wherein the positioning member is effective to limit both of said first and second rotatable members.

24. An apparatus according to claim 14, wherein axes of rotation of said first and second rotatable members are substantially parallel with each other.

25. An apparatus according to claim 14, wherein said second helical gear is not driven through said first helical gear.

* * * * *

UNITED STATES PATENT AND TRADEMARK OFFICE

CERTIFICATE OF CORRECTION

PATENT NO. : 5,452,064
DATED : September 19, 1995
INVENTOR(S) : MITSUGU INOMATA

It is certified that error appears in the above-indentified patent and that said Letters Patent is hereby corrected as shown below:

Column 2,
line 66, "to" should be deleted.
Column 4,
line 36, "30" should read --31--.
Column 5,
line 6, "36" should read --30--.
Column 8,
line 36, "position" should read --positions--; and
line 37, "2" should read --22--.
Column 9,
line 49, "a" (second occurrence) should be deleted; and
line 52, "gear" should read --gears--.
Column 11,
line 41, "5." should read --5'.--.

Signed and Sealed this

Ninth Day of January, 1996

Bruce Lehman

*Attest:*

BRUCE LEHMAN

*Attesting Officer*

*Commissioner of Patents and Trademarks*